US007902951B2

(12) United States Patent
Findeisen

(10) Patent No.: US 7,902,951 B2
(45) Date of Patent: Mar. 8, 2011

(54) HERMETICALLY SEALED ELECTRICAL APPARATUS

(75) Inventor: Jörg Findeisen, Dresden (DE)

(73) Assignee: Siemens AG, Munich (DE)

( * ) Notice: Subject to any disclaimer, the term of this patent is extended or adjusted under 35 U.S.C. 154(b) by 478 days.

(21) Appl. No.: 11/995,902

(22) PCT Filed: Jul. 14, 2006

(86) PCT No.: PCT/EP2006/064293

§ 371 (c)(1),
(2), (4) Date: Jan. 16, 2008

(87) PCT Pub. No.: WO2007/009961

PCT Pub. Date: Jan. 25, 2007

(65) Prior Publication Data

US 2008/0197955 A1 Aug. 21, 2008

(30) Foreign Application Priority Data

Jul. 17, 2005 (DE) ..... 10 2005 034 851

(51) Int. Cl.
*H01F 27/10* (2006.01)

(52) U.S. Cl. ..... 336/58; 336/57; 174/12 R; 174/14 R

(58) Field of Classification Search ..... 336/58, 336/57; 174/12 R, 14 R
See application file for complete search history.

(56) References Cited

U.S. PATENT DOCUMENTS 3,335,380 A * 8/1967 Gramlich et al. ..... 336/90
5,900,538 A * 5/1999 Bastian ..... 73/49.2
5,976,226 A * 11/1999 Bastian et al. ..... 96/6

* cited by examiner

*Primary Examiner*—Anh T Mai
*Assistant Examiner*—Joselito Baisa
(74) *Attorney, Agent, or Firm*—Laurence A. Greenberg; Werner H. Stemer; Ralph E. Locher

(57) ABSTRACT

An electric apparatus, preferably a transformer, is hermetically sealed and filled with a dielectric liquid. Devices for recording heat-related volume variations of the dielectric liquid are contained in the apparatus. Volume variations are compensated with the aid of a gas cushion, which is thermally uncoupled from the dielectric liquid. The largest part of the gas cushion is arranged in a container separated from the dielectric liquid expansion tank. All the components of volume compensating devices are constructed in such a way that the operation of used monitoring devices, in particular, also the protection against Buchholz relays waves is maintained. The invention makes it possible to hermetically seal the transformer, thereby substantially reducing the aging of the dielectric liquid and the cellulose-based insulating material of the apparatus. Furthermore, the inventive device makes it possible to avoid the use of air-dehumidifiers and respective conduits.

11 Claims, 1 Drawing Sheet

HERMETICALLY SEALED ELECTRICAL APPARATUS

BACKGROUND OF THE INVENTION

Field of the Invention

The invention relates to an electrical apparatus which is filled with an insulating liquid and is hermetically sealed, preferably to a transformer and devices for absorbing the thermally dependent volume fluctuations of the insulating liquid contained therein.

The invention allows hermetic sealing of the transformer, and thus a considerable reduction in the ageing of the insulating liquid and of the apparatus dielectrics, which are constructed based on cellulose. The use of the arrangement according to the invention also makes it possible to dispense with air dehumidifiers and associated pipelines.

Transformers and other electrical appliances are filled, as is known, with oil or other insulating liquids for cooling and insulation. During operation of the transformer, load fluctuations and other influences result in considerable changes in the temperature of the insulating liquid in the transformer. It is prior art to use an oil expansion vessel to absorb the volume changes, caused by these temperature fluctuations, of the insulating liquid in the transformer, with this oil expansion vessel being connected to the transformer vessel via a pipeline which is provided with a gradient. Expansion vessels such as these are described, for example, in DE 195 27763 C2. These expansion vessels have the disadvantage that the oil surface makes contact with the outside air, making it necessary to use so-called air dehumidifiers. The air is passed over a desiccant in these air dehumidifiers, and is dehumidified in the process. The adsorption capability of the desiccant (hygroscopic capacity) is used up in this case, and the desiccant must be replaced regularly. The visual examinations that are required periodically as well as the regular replacement of the desiccant, in particular in environments in which the air humidity is high, represent a considerable cost factor (recommended maintenance interval: 3 months). These air dehumidifiers also do not offer reliable sealing against the absorption of moisture and oxygen through the insulating liquid, in particular if the transformer is cooled down rapidly.

In order to prevent the oil from deteriorating as a result of atmospheric influences, it is expedient to seal the tank with the oil hermetically and such that it is pressure-tight. Hermetically sealed transformers with corrugated tanks have been used for some time for this purpose, for relatively low ratings. For higher rating transformers, this tank design is unsuitable because of the required resistance to vacuum and the necessary large volume change. However, there is increasingly also a requirement for transformers such as these to be hermetically sealed.

For this purpose, DE 1971624 U1 and DE 10010737 C2 disclose solutions in which the change in the volume of the insulating liquid is absorbed by special expansion radiators. This solution has the disadvantage that the equalization processes result in mechanical deformation of the radiator, thus endangering its strength.

Furthermore, the deformation of the radiator leads to a change in the cross section of the oil and air circulation. The expansion radiators which are required for this solution result in high costs, cannot be hot-dip galvanized, and are not freely available commercially at the moment. Furthermore, these expansion radiators cannot be manufactured with stepped elements, although this is necessary for relatively high rating transformers whose cooling system is located within the loading gauge for rail transport.

Furthermore, expansion vessels are known which use a membrane in the main chamber to separate the insulating liquid from the surrounding air. One such is described in DE 3206368. Although these expansion vessels offer reliable sealing of the insulating liquid from the surrounding air, they nevertheless require an air dehumidifier, however, and this is associated with the already mentioned disadvantages. Furthermore, contact with the surrounding air leads to ageing of the membrane and, as a result of this, therefore to technical uncertainties.

It is also known for gas cushions to be used directly underneath the cover of transformers (DE710389, U.S. Pat. No. 3,544,938). However, this solution does not offer the capability to separate damaging gases from the gas cushion and requires costly lengthening of the insulating parts of the bushings on the oil side. Arrangement of the gas cushion directly above the oil level leads to heat being transmitted to the gas cushion when the transformer is heated. This heating of the gas cushion leads to an additional pressure rise in the gas cushion and therefore in the entire transformer vessel. In addition to the need to design the transformer vessel for this pressure, these major temperature and pressure fluctuations result in major changes in the solubility of the inert gas, which forms the gas cushion, in the insulating liquid. This can lead to the formation of gas bubbles in the insulating liquid if the transformer is cooled down quickly.

DE 2308955 discloses a solution for transformers with gas cushions in which a disc which floats on the insulating liquid is used in an attempt to reduce the thermal coupling between the gas cushion and the oil temperature. This can be achieved only partially, because the gas cushion remains in its position directly above the oil.

BRIEF SUMMARY OF THE INVENTION

The invention described in the following text makes it possible to compensate for the change in the oil volume during operation of the transformer, while avoiding the disadvantages mentioned above. The present invention uses a gas cushion to absorb the thermally dependent volume fluctuations of the insulating liquid. An inert gas, preferably nitrogen, is used for this gas cushion. According to the invention, this gas cushion is separated from the insulating liquid by a membrane. This separation largely avoids the gas being dissolved in the insulating liquid thus avoiding so-called bubble formation when the capability for gas to be dissolved in the insulating liquid decreases when the pressure decreases rapidly as a result of the electrical apparatus cooling down. It is therefore possible to make use of a greater pressure range, without the risk of dangerous gas bubble formation.

A membrane arranged according to the invention is not subject to the influences of the atmosphere (oxygen, ozone, water vapor), and achieves a long life.

The membrane (gas sack) which is used for separation between the insulating liquid and the gas cushion is, according to the invention, not designed for the size of the gas cushion, but only to absorb the volume fluctuations of the insulating liquid. The gas volume which is required to restrict the maximum pressure is made available in additional containers. This makes it possible to use a small gas sack, which not only results in a reduction in the costs but also in a further reduction in the gas diffusion, because of the smaller membrane area between the gas and the insulating liquid.

Operation takes place with unsaturated oil in all operating states. Mixing of gases created by oil breakdown with the gas of the gas cushion is avoided. The prevention of some of the gas of the gas cushion being dissolved in the insulating liquid obviously requires the volume of the gas compression chamber to be somewhat increased.

By advantageous arrangement of the gas compression chambers, the separation of the containers offers the capability to keep the maximum gas temperature considerably below the maximum operating temperature of the transformer. This offers the capability to reduce the required volume or the maximum operating pressure. The arrangement of the gas compression chambers is flexible.

In one particular embodiment, the part of the vessel which contains the membrane is arranged, such that it is easily accessible, in the lower area of the transformer. This makes it possible to reduce the physical height of the transformer, and to design transportable fully-equipped transformers with a higher rating.

The design of the transformer according to the invention makes it possible to completely seal the insulating liquid from the atmosphere/surrounding air. Absorption of moisture and oxygen by the insulating liquid is prevented. Any influence on the electrical breakdown strength of the insulating liquid as a result of moisture is avoided, and ageing of the insulating liquid and of the cellulose of the insulating parts is considerably reduced.

There is no need for the air dehumidifier or for the associated pipelines. There is no need to regularly check the state of the desiccant in the air dehumidifier, and costs are saved by avoiding the need for costly regular replacement of the desiccant. This avoids environmental protection and disposal problems resulting from worn-out desiccant.

The design of the transformer according to the invention results in reliable hermetic sealing of the transformer, without any need for components requiring a high degree of maintenance effort.

Furthermore, the described solution ensures the full functionality of the Buchholz relay. The transformer described in the invention can be designed without any problems such that all of the assemblies which are required for the function of the hermetic seal are arranged outside the actual body of the transformer, and use the same external connections as a conventional type of transformer. This means that it is simple to retrofit existing transformers.

In contrast to other solutions, in the case of the transformer design according to the invention, defects in the hermetically sealing volume compensation apparatus do not lead to failure of the transformer, and, instead, this can continue to operate as a conventional transformer.

In a further embodiment, the additional container for the gas cushion is installed separately from the transformer thus making it possible to match the system to existing areas. It is advantageous to use a location where the temperature fluctuations are small for installation of the containers for the gas cushion.

In a further advantageous refinement, the gas containers are protected against excess of heating by a solar protection panel or a sunshade.

In a further advantageous embodiment of the invention, the gas compression area (12) is equipped with an additional pressure valve which responds at a considerably lower pressure than the large-area pressure relief valve which operates with relatively little inertia and protects the electrical apparatus against pressure waves which occur as a result of decomposition of the insulating liquid in the event of damage.

If the transformer is operated overloaded in a normal environmental temperature, then the gas compression area, which is designed for the maximum environmental temperature, is able to absorb the additional volume increase of the insulating liquid. If the overloading occurs at the maximum environmental temperature, then, in the case of the transformer designed according to the invention, this does not lead to response of the pressure-relief valve or hermetic-seal protection, with the disconnection of the transformer associated with this, as well as the oil loss associated with the response of these monitoring appliances as in the case of other hermetically sealed transformers, but this just results in a small gas loss, as a result of the gas-outlet valve responding at a lower pressure. It is still possible to operate the transformer normally. All that is necessary is to replace the amount of gas that is being lost, as far as the opposite extreme operating situation (no load or disconnection at the minimum environmental temperature). In addition, if this is not done, this just results in an increased risk to the sealing system, and the deformation of the tank and other components is precluded since these transformers are designed to be vacuum-resistant in order to allow the normal filling processes.

The invention will be described in more detail in the following text with reference to exemplary embodiments.

DESCRIPTION OF THE INVENTION

Figure 1:
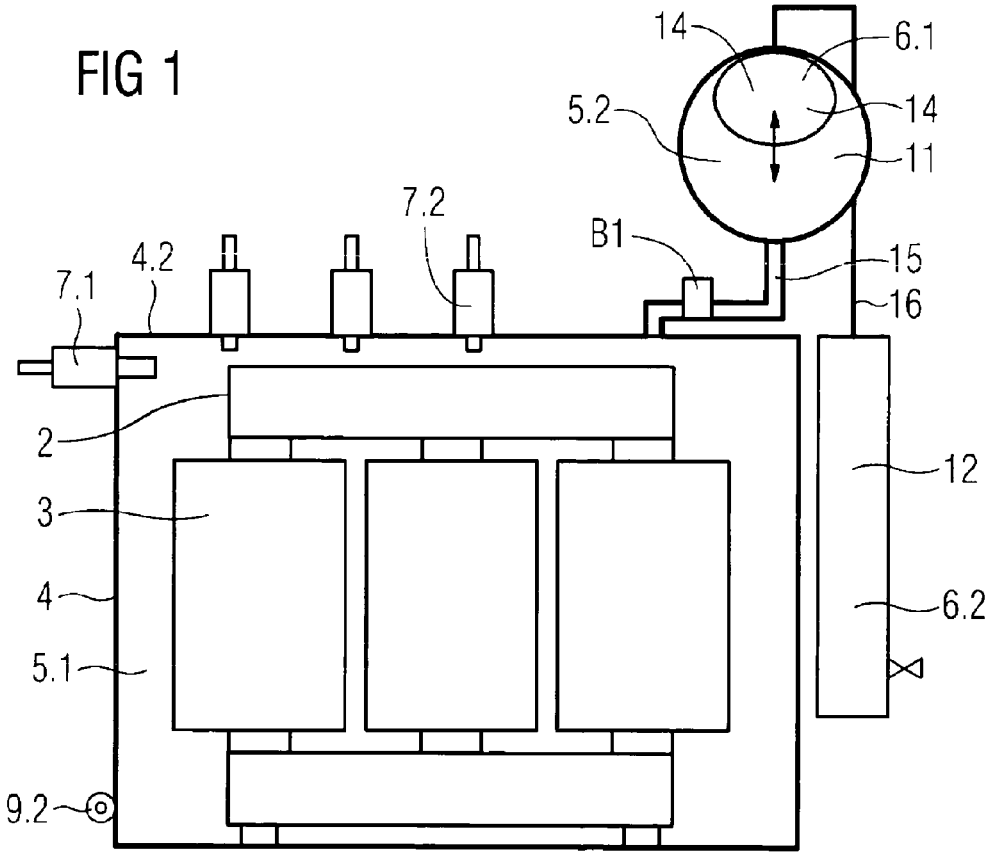
FIG. 1 shows a transformer with a hermetically sealed housing filled with an insulating liquid.

FIG. 1 shows a transformer (2) with a hermetically sealed housing (4) which is filled with an insulating liquid (5.1). The insulating liquid flows into an expansion vessel (11) via a pipeline (15), which is equipped with a Buchholz relay (B1), as a consequence of the thermally dependent volume fluctuations of the insulating liquid. A membrane (14) is accommodated in this expansion vessel (11), separating the insulating liquid (5.2) from the gas (6.1).

The expansion vessel (11) is equipped, via a pipeline (16), with further chambers for the gas cushion (12), which are arranged to provide thermal decoupling between the gas cushion (6.2) and the temperature of the insulating liquid in the transformer. In the exemplary embodiment, both the expansion vessel (11) and the gas compression chamber (12), which is thermally decoupled from the transformer, are formed by sheet-metal cylinders. Designing the gas compression containers as external cylinders makes it possible to provide the required compression volume at very low costs.

Figure 2:
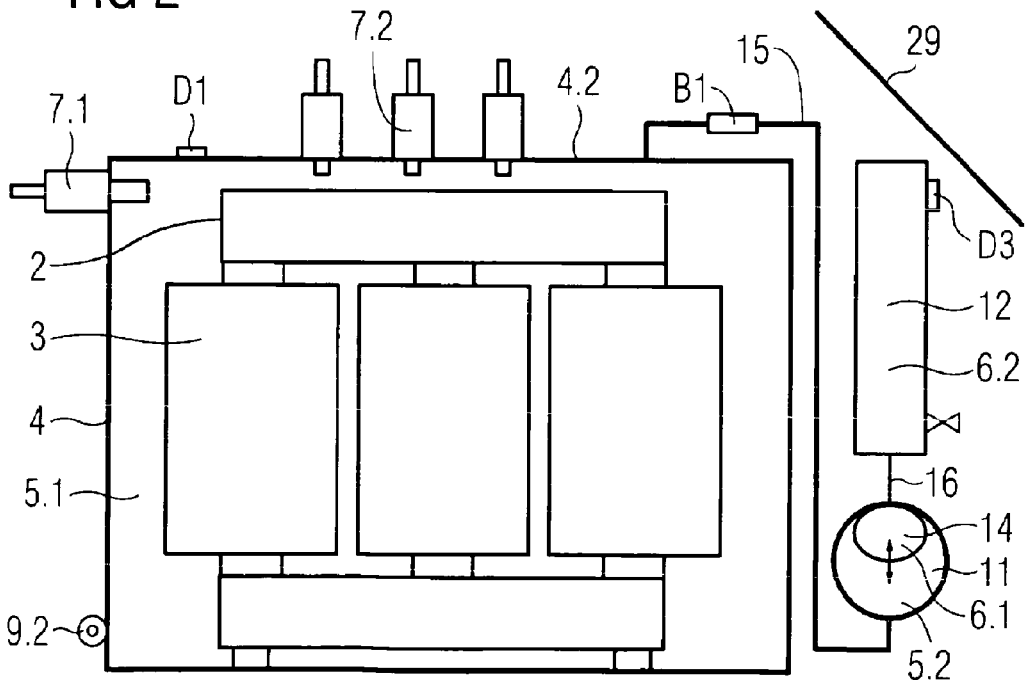
FIG. 2 is a similar view of an alternative embodiment of the invention.

FIG. 2 shows one exemplary embodiment of the invention, in which the expansion vessel for the insulating liquid (11) is arranged underneath the upper edge of the housing (4.2) of a transformer, and is connected by means of a connection line (15) to the vessel (4) such that the full functionality of the Buchholz relay is ensured.

In the event of damage, gases produced by decomposition of the insulating liquid rise upwards and are collected in the Buchholz relay (B1).

The arrangement of the gas compression chambers (12) according to the invention, and in contrast to other solutions, makes it possible to use the inrush protection integrated in the Buchholz relay (B1) resulting from the flow of the insulating liquid through a connection line of appropriately large cross section (15). The pressure waves which are created by gas development in the event of high-energy discharges lead to a powerful flow of insulating liquid in the direction of the expansion vessel (11), and lead to operation of a ram-pressure valve, which is arranged in the liquid flow, in the Buchholz relay (B1).

The arrangement of the expansion vessel (11) as illustrated in the exemplary embodiment makes it possible to considerably reduce the overall height of the transformer. This also considerably simplifies the design of high-rating transformers which can be transported in the fully equipped state.

A solar protection panel (29) prevents excessive heating of the gas compression chamber.

Furthermore, the gas compression chamber (12) is equipped with an additional pressure valve (D3) which responds at a considerably lower pressure than the large-area pressure relief valve (D1) which operates with relatively little inertia and protects the electrical apparatus against pressure waves which occur as a result of decomposition of the insulating liquid in the event of damage.

When the transformer is operated overloaded at a normal environmental temperature, then the gas compression area (12), which is designed for the maximum environmental temperature, is able to absorb the additional volume increase of the insulating liquid. If the overload occurs at the maximum environmental temperature, then, in the case of the transformer designed according to the invention, the pressure-relief valve (D1) or the hermetic protection does not respond, with the disconnection of the transformer associated with this and with the loss of oil associated with the response of these monitoring appliances, as in the case of other hermetically sealed transformers, but this just results in a small gas loss as a result of the gas-outlet valve responding at a lower pressure.

The invention claimed is:

1. A transformer, comprising:

a sealed housing filled with an insulating and cooling liquid and a gas cushion for absorbing thermally dependent volume fluctuations of the insulating and cooling liquid;

an expansion vessel for the insulating and cooling liquid having a size and configuration such that a tank of said expansion vessel is completely filled with insulating and cooling liquid in all operating states of the transformer; and a membrane forming a closed gas sack for the gas cushion disposed to separate the gas cushion for absorbing the volume fluctuations of the insulating and cooling liquid from the insulating and cooling liquid, said membrane being hermetically separated from an ambient atmosphere.

2. The transformer according to claim 1, which comprises a container separate from said expansion vessel and accommodating a major portion of the gas cushion, said expansion vessel defining a gas compression chamber arranged to ensure thermal decoupling from hot layers of the insulating and cooling liquid in an upper part of the transformer.

3. The transformer according to claim 2, wherein said container containing the majority of the gas cushion is protected by measures against heating by direct solar radiation.

4. The transformer according to claim 3, wherein said measures are selected from the group consisting of a solar protection panel and a paint coating.

5. The transformer according to claim 1, which comprises a connection line extending between said housing and said expansion vessel and ensuring that rising gases are reliably transported to a Buchholz relay.

6. The transformer according to claim 1, wherein said housing, said expansion vessel for the insulating and cooling liquid, and said gas compression chamber together form a pressure-resistant, hermetically sealed unit.

7. The transformer according to claim 1, wherein said housing has an upper edge and said expansion vessel for the insulating liquid is disposed underneath said upper edge and connected to said housing by way of a connection line such that a complete functionality of a Buchholz relay is ensured.

8. The transformer according to claim 1, which comprises a shut-off means configured to open if a specific pressure in an interior of said housing apparatus is exceeded, for reducing an overpressure in said housing.

9. The transformer according to claim 1, which further comprises apparatuses for collection and emission of gases during an operation of the transformer.

10. The transformer according to claim 1, which further comprises an inert operating pressure outlet valve fitted to said gas compression chamber and configured to respond at a considerably lower pressure than a large-area pressure relief valve operating with relatively little inertia and protecting the transformer against pressure waves which occur as a result of decomposition of the insulating and cooling liquid in the event of damage.

11. The transformer according to claim 1, wherein said expansion vessel containing said membrane is equipped with apparatuses for detection of a filling level of the insulating and cooling liquid and/or with apparatuses for detection of a pressure.

* * * * *